US007816850B2

(12) United States Patent
Ishimoto et al.

(10) Patent No.: US 7,816,850 B2
(45) Date of Patent: Oct. 19, 2010

(54) DISPLAY DEVICE INCLUDING GAS DISCHARGE TUBES, AND METHOD OF MANUFACTURING DISPLAY DEVICE

(75) Inventors: Manabu Ishimoto, Kobe (JP); Hitoshi Hirakawa, Kobe (JP); Kenji Awamoto, Kobe (JP)

(73) Assignee: Shinoda Plasma Co., Ltd., Kobe (JP)

( * ) Notice: Subject to any disclaimer, the term of this patent is extended or adjusted under 35 U.S.C. 154(b) by 307 days.

(21) Appl. No.: 11/898,913

(22) Filed: Sep. 17, 2007

(65) Prior Publication Data

US 2008/0007176 A1 Jan. 10, 2008

(51) Int. Cl.
*H01J 63/04* (2006.01)
*H01J 65/00* (2006.01)
*H01J 17/49* (2006.01)

(52) U.S. Cl. ..... 313/493; 313/484; 313/485; 313/491; 313/582

(58) Field of Classification Search ..... 313/484–485, 313/491, 493, 234, 422, 494, 582, 607; 350/70; 362/614

See application file for complete search history.

(56) References Cited

U.S. PATENT DOCUMENTS

| | | | |
|---|---|---|---|
| 2003/0048068 | A1 | 3/2003 | Yamada et al. |
| 2003/0052592 | A1 | 3/2003 | Shinoda et al. |
| 2003/0214224 | A1 | 11/2003 | Awamoto et al. |
| 2006/0170327 | A1 * | 8/2006 | Hirakawa et al. ..... 313/493 |

FOREIGN PATENT DOCUMENTS

| | | |
|---|---|---|
| JP | 61-208732 | 9/1986 |
| JP | 5-190153 | 7/1993 |
| JP | 11-162358 | 6/1999 |
| JP | 2003-86141 | 3/2003 |
| JP | 2003-92085 | 3/2003 |
| JP | 2003-331730 | 11/2003 |
| JP | 2004-134191 | 4/2004 |
| JP | 2004-178854 | 6/2004 |
| JP | 2004178854 A * | 6/2004 |

OTHER PUBLICATIONS

International Search Report (PCT/ISA/210) of the International Application No. PCT/JP2005/004745 (mailed on Aug. 2, 2005).

* cited by examiner

*Primary Examiner*—Nimeshkumar D Patel
*Assistant Examiner*—Peter R Haderlein
(74) *Attorney, Agent, or Firm*—Staas & Halsey LLP

(57) ABSTRACT

A display device includes a plurality of gas discharge tubes sandwiched between a front support plate and a rear support plate. A plurality of signal electrodes are formed on the rear support plate to extend along the longitudinal direction of the gas discharge tubes. The signal electrodes are divided into a plurality of groups. The distance between adjacent ones of the signal electrodes in each group has a first distance. The distance between adjacent ones of the signal electrodes between adjacent groups has a second distance that is larger than the first distance. Thus, a space may be provided between the two adjacent gas discharge tubes of the respective adjacent groups.

10 Claims, 8 Drawing Sheets

DISPLAY DEVICE INCLUDING GAS DISCHARGE TUBES, AND METHOD OF MANUFACTURING DISPLAY DEVICE

FIELD OF THE INVENTION

The present invention relates generally to a display device, and more particularly to a display device having a plurality of thin elongated gas discharge tubes in parallel for displaying any types of pictures.

BACKGROUND ART

A display device has been proposed, which includes gas discharge tubes disposed side by side, and in which a gas discharge is produced by application of a voltage through external electrodes, whereby light is emitted from phosphors within the tubes. (See Japanese Patent Application Publication JP 2003-86141-A.)

Such a display device includes: gas discharge tubes, each containing a discharge gas and having a phosphor layer therein, supports contacting and supporting the gas discharge tubes, and a plurality of electrodes disposed on the surfaces of the supports facing the gas discharge tubes for externally applying a voltage to the discharge tubes of the display device to cause a discharge to take place within the discharge tubes to thereby provide picture display.

DISCLOSURE OF THE INVENTION

It is desirable that the precision of the registration of the address or signal electrodes and the gas discharge tubes of such a display device should be as high as possible. However, achievement of such high precision requires complicated manufacturing process, causing the manufacturing cost to increase.

In order to simplify the process for manufacturing prior art display devices, registration between the address electrodes and the gas discharge tubes was achieved in a simple manner by forming the address electrodes at predetermined intervals on the rear support and arranging the gas discharge tubes on the rear support in such a manner as to make adjacent gas discharge tubes contact with each other. However, dimensions of the gas discharge tubes vary, and hence a cumulative error in the tube width may cause undesirable misregistration between the address electrodes and the gas discharge tubes. On the other hand, if the gas discharge tubes and the address electrodes are accurately registered before bonding them, the number of steps for bonding increases, which increases the manufacturing cost.

The inventors have recognized that there is a need for achieving registration between the address or signal electrodes and the gas discharge tubes at a low cost.

An object of this invention is to achieve registration between signal electrodes and gas discharge tubes at a low cost.

Another object of the invention is to provide disposition of a plurality of gas discharge tubes on a rear support in such a manner as to make it possible to achieve registration between signal electrodes and the gas discharge tubes.

SUMMARY OF THE INVENTION

In accordance with an aspect of the present invention, a display device includes: a plurality of gas discharge tubes sandwiched between a front support plate and a rear support plate; a plurality of display electrodes formed on a surface of the front support plate facing the gas discharge tubes to extend across the axial direction of the gas discharge tubes; and a plurality of signal electrodes formed on a surface of the rear support plate facing the gas discharge tubes to extend along the longitudinal direction of the gas discharge tubes. The plurality of signal electrodes are divided into a plurality of groups, each including a predetermined number of signal electrodes. The distance between adjacent ones of the signal electrodes in each group is substantially equal to a first distance. The distance between the signal electrode at an end of each group of the signal electrodes and the signal electrode at the adjacent end of the adjacent group being substantially equal to a second distance that is larger than the first distance.

In accordance with another aspect of the invention, a display device includes: a plurality of groups of gas discharge tubes disposed in parallel between a front support plate and a rear support plate; the front support plate having a first plurality of electrodes extending substantially in parallel disposed on a surface of the front support plate facing the gas discharge tubes. The rear support plate having a second plurality of electrodes extending substantially in parallel are disposed on a surface of the rear support plate facing the gas discharge tubes, the plurality of groups of gas discharge tubes being disposed respectively in association with the second plurality of electrodes. The gas discharge tubes are disposed in such a manner that the adjacent gas discharge tubes in each group are substantially in contact with each other, and that the gas discharge tube at an end of each group of the gas discharge tubes and the gas discharge tube at the adjacent end of the adjacent group are spaced from each other.

The invention also relates to a method of manufacturing the display device as described above.

According to the invention, a display device including a rear support allows registration between its signal electrodes and gas discharge tubes at a low cost.

DESCRIPTION OF THE PREFERRED EMBODIMENTS

The invention will be described with reference to the accompanying drawings. Throughout the drawings, similar symbols and numerals indicate similar items and functions.

Figure 1:
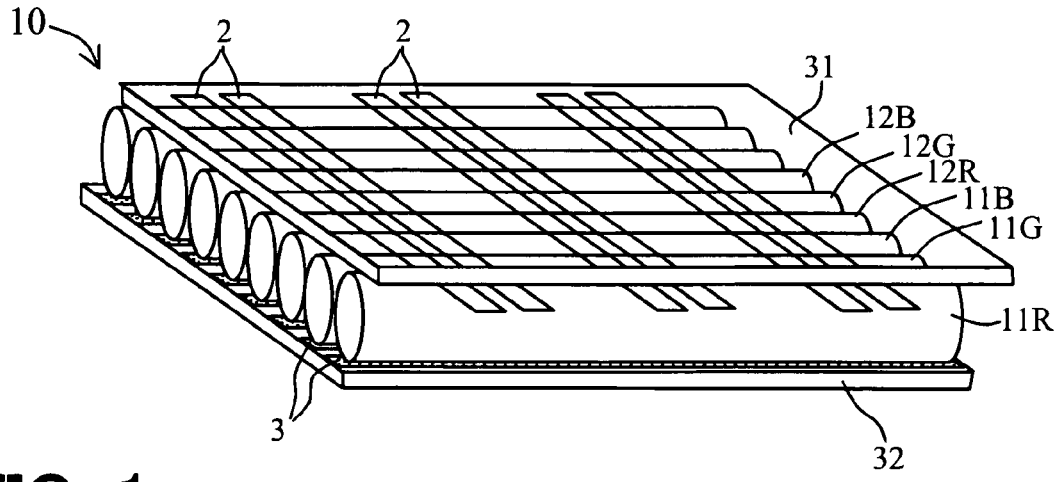
FIG. 1 shows an example of the structure of part of a large display device, in accordance with an embodiment of the present invention.

FIG. 1 shows an example of the structure of part of a large display device 10, in accordance with an embodiment of the present invention. In FIG. 1, the display device 10 includes a plurality of transparent thin elongated gas discharge tubes 11R, 11G, 11B, 12R, 12G, 12B, . . . , disposed substantially in parallel, a front support 31 comprised of a transparent, front support sheet or thin plate, a rear support 32 comprised of a transparent or opaque, rear support sheet or thin plate, a plurality of pairs of display electrodes or main electrodes 2, and a plurality of signal or address electrodes 3. The front support 31 and the rear support 32 are made of a material such as elastic PET film, glass or the like. It is desirable for the rear support 32 to be black or dark in color itself or to have a separate black sheet bonded to its front or rear surface in order to provide enhanced contrast in picture display.

Typically, phosphor support members having respective red, green and blue (R, G, B) phosphor layers formed or deposited thereon are inserted into the interior discharge spaces of the thin gas discharge tubes 11R, 11G, 11B, 12R, 12G, 12B, . . . , respectively. Discharge gas is introduced into the interior discharge space of each gas discharge tube, and the gas discharge tube is sealed at its opposite ends. Alternatively, the phosphor layer may be formed or deposited on the inner surface of an associated gas discharge tube without using the support member. The signal electrodes 3 are formed on the rear support sheet 32 and extend along the longitudinal direction of the respective discharge tubes 11R, 11G, 11B, . . . . The pairs of display electrodes 2 are formed on the front support sheet 31 and extend in the direction crossing the signal electrodes 3. A distance providing a non-discharging region or non-discharging gap is provided between each pair of display electrodes 2 and an adjacent pair of display electrodes 2.

The signal electrodes 3 and the pairs of display electrodes 2 are brought into intimately contact respectively with the lower and upper peripheral surfaces of the gas discharge tubes 11R, 11G, 11B, . . . , when the display device 10 is assembled. In order to provide better contact, an electrically conductive adhesive may be placed between the display electrodes and the gas discharge tubes.

In plan view of the display device 10 seen from the front side, the intersections of the signal electrodes 3 and the pairs of display electrodes 2 provide unit light-emitting regions. Display is provided by using either one electrode of each pair of display electrodes 2 as a scanning electrode, generating a selection discharge at the intersection of the scanning electrode with the signal electrode 3 to thereby select a light-emitting region, and generating a display discharge between the pair of display electrodes 2 using the wall charge formed by the selection discharge on the region of the inner tube surface at the selected region, which, in turn, causes the associated phosphor layer to emit light. The selection discharge is an opposed discharge generated within each gas discharge tube 11R, 11G, 11B, . . . between the vertically opposing scan electrode and the signal electrode 3. The display discharge is a surface discharge generated within each gas discharge tube 11R, 11G, 11B, . . . between the two display electrodes of each pair of display electrodes disposed in parallel in a plane.

Figure 2A:
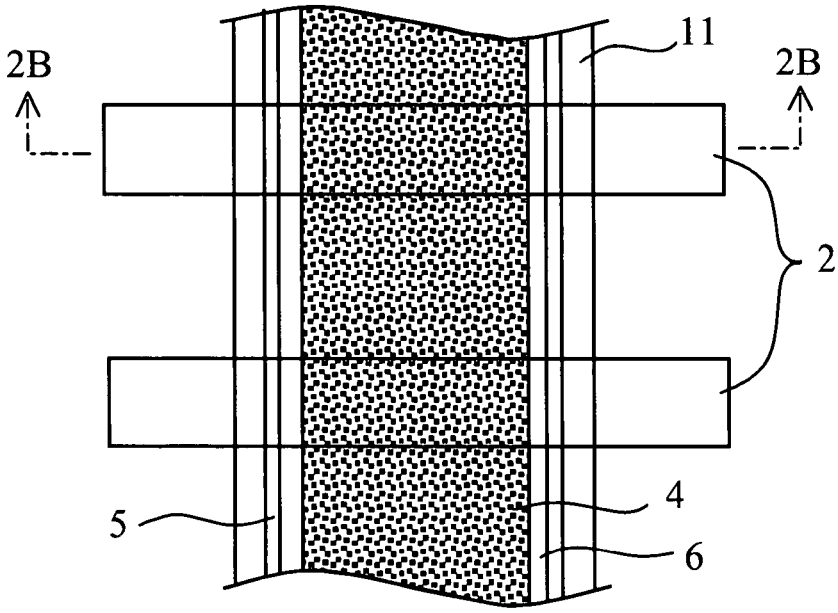
FIG. 2A is a partial enlarged plan view of the gas discharge tube in the vicinity of the pair of display electrodes.
Figure 2B:
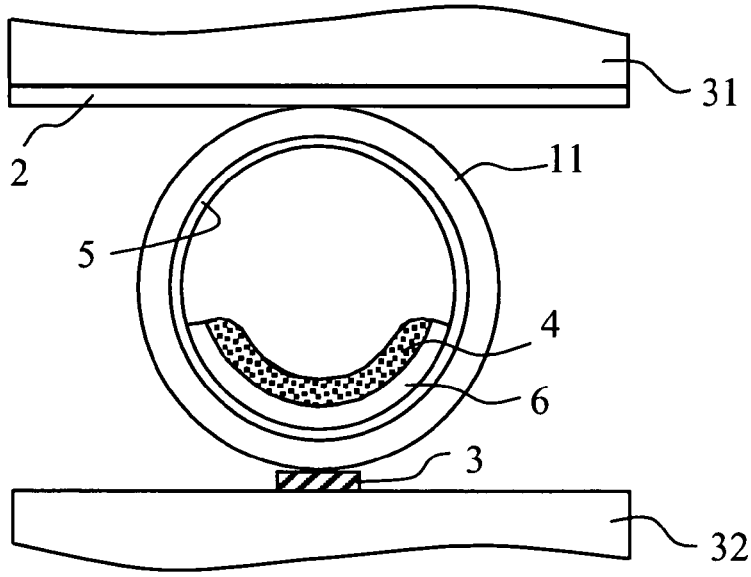
FIG. 2B is a cross-sectional view of the gas discharge tube along a line 3B-3B in FIG. 2A.

FIG. 2A is a partial enlarged plan view of the gas discharge tube 11 in the vicinity of the pair of display electrodes 2. FIG. 2B is a cross-sectional view of the gas discharge tube 11 along a line 3B-3B in FIG. 2A. In FIGS. 2A and 2B, an electron emissive film 5 of MgO is formed on the inner surface of the gas discharge tube 11, and a support member 6 with a phosphor layer 4 formed thereon is disposed within the gas discharge tube 11.

As described above, the gas discharge tube 11 is arranged such that the phosphor layer 4 is caused to emit light through discharge by the plurality of pairs of display electrodes 2 disposed in contact with the tube outer wall surface, whereby a number of light-emitting points (display portions) can be provided in the single tube. The gas discharge tube 11 is formed of a transparent insulating material, e.g. borosilicate glass, and, typically, has a tube diameter of 2 mm or smaller and a tube length of 300 mm or larger.

The support member 6 is formed of a transparent insulating material, e.g. borosilicate glass, and is a member separate from the tubular envelope (glass tube) of the gas discharge tube 11, and has the phosphor layer 4 formed thereon. The support member 6 may be disposed within the glass tube by applying a paste of phosphor over the support member 6 outside the glass tube and then baking the phosphor paste to form the phosphor layer 4 on the support member 6, before inserting the support member 6 into the glass tube. As the phosphor paste, a desired one of various phosphor pastes known in this technical field may be employed.

The pair of display electrodes 2 and the signal electrode 3 can generate discharges in the discharge gas within the tube by applying voltages between them. The electrode structure of the gas discharge tube 11 shown in FIGS. 2A and 2B is such that the three electrodes are disposed in one light-emitting region, and that the discharge between the pair of display electrodes generates a discharge for display. However, the electrode structure is not limited to such a structure. A display discharge may be generated between the display electrode 2 and the signal electrode 3. In other words, an electrode structure of a type employing a single display electrode may be employed instead of each pair of display electrodes 2, in which the single display electrode 2 is used as a scanning electrode so that a selection discharge and a display discharge (opposed discharge) are generated between the single display electrode 2 and the signal electrode 3.

The electron emissive film 5 emits charged particles, when it is bombarded with the discharge gas having energy above a given value. When a voltage is applied between the pair of display electrodes 2, the discharge gas contained in the tube is excited. The phosphor layer 4 emits visible light by converting thereinto vacuum ultraviolet radiation generated in the de-excitation process of the excited rare gas atoms.

Figure 3:
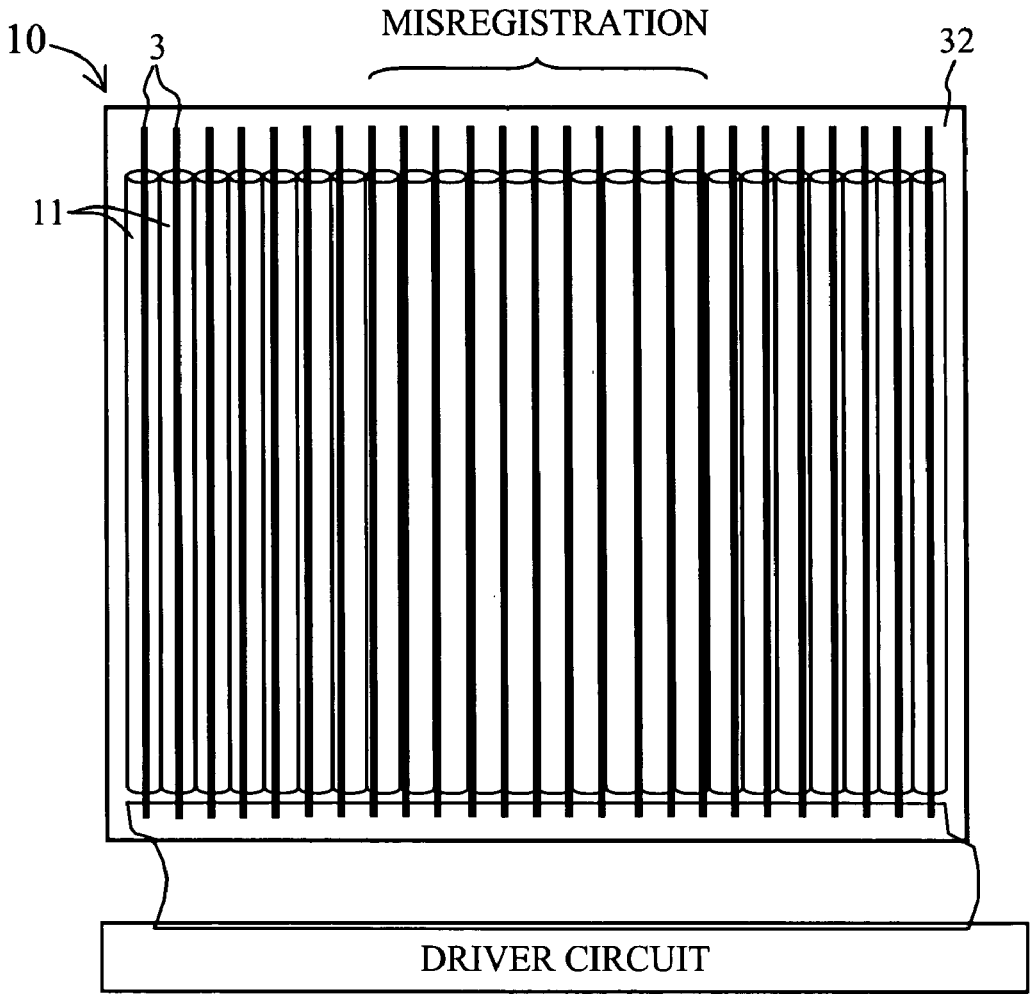
FIG. 3 is useful for explaining how misregistration of address or signal electrodes formed on a rear support and the gas discharge tubes in a prior art display device can be generated.

FIG. 3 is useful for explaining how misregistration of the address or signal electrodes 3 formed on the rear support 32 and the gas discharge tubes 11 in a prior art display device can be generated. When the plurality of gas discharge tubes 11 are disposed on the rear support 32 with the plurality of address or signal electrodes 3 formed thereon at predetermined intervals, e.g. at intervals equal to an ordinary tube diameter of the gas discharge tubes 11, undesirable misregistration between the address electrodes 3 and the gas discharge tubes 11 may be generated due to a cumulative error in tube width or tube diameter of the gas discharge tubes 11 because of variations in dimensions of the gas discharge tubes 11 from tube to tube. Typically, the variation in tube width is about 1% of the tube diameter. For example, for the tube width of 1 mm, there is an error of about +0.005 mm or 0.01 mm. Undesirable misregistration between the address electrodes 3 and the gas discharge tubes 11 is seen in the center part of FIG. 3.

Figure 4A:
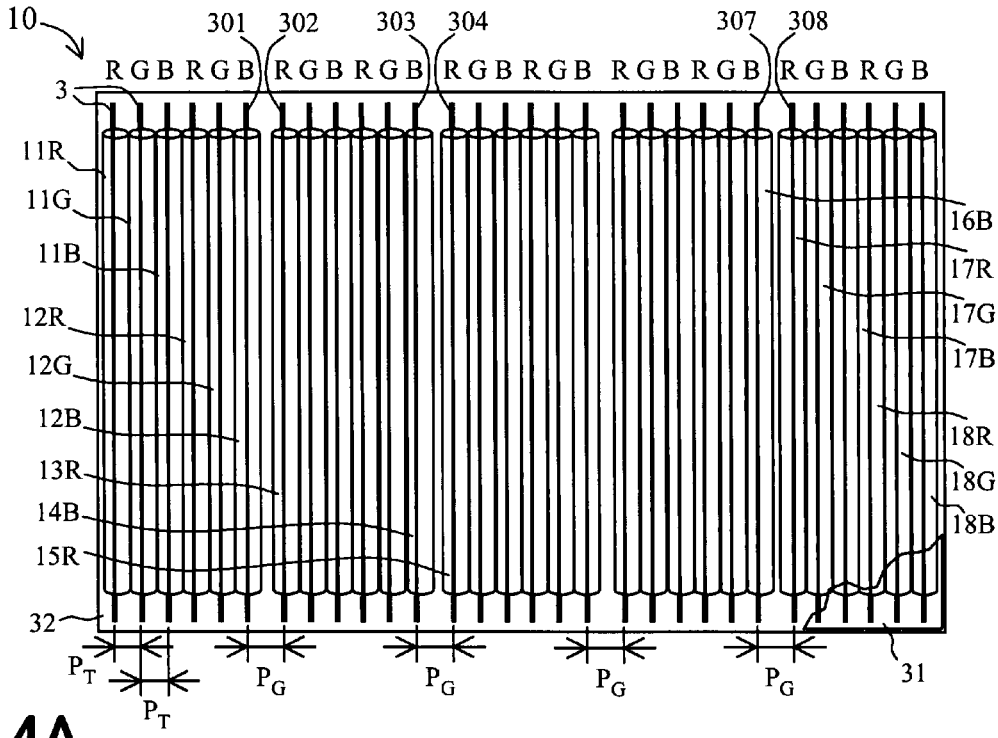
FIGS. 4A and 4B are front and side views of a display device in accordance with an embodiment of the invention, which includes a plurality of blocks of gas discharge tubes.
Figure 4B:
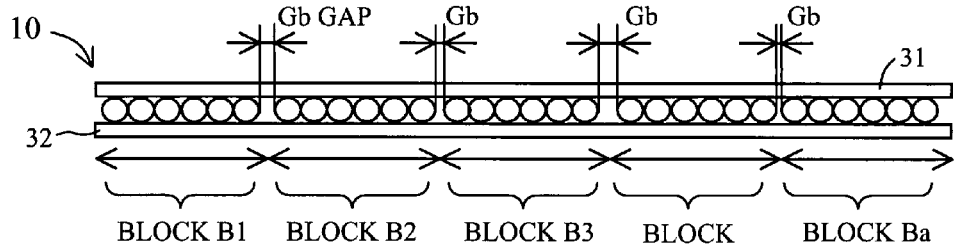

FIGS. 4A and 4B are front and side views of a display device 10 in accordance with an embodiment of the invention. The display device 10 includes a plurality of blocks B1, B2, . . . , Ba of gas discharge tubes (11R, 11G, 11B, 12R, 12G, 12B), . . . , and (17R, 17G, 17B, 18R, 18G, 28B).

As shown in FIGS. 4A and 4B, a plurality of blocks of signal electrodes 3 are formed on a rear support 32. Each block of signal electrodes includes 3×a signal electrodes 3, where the number 3 represents the number of primary colors R, G and B, and a presents a positive integer. The number a is preferably 3 or 4. In the illustrated embodiment, it is assumed that the number a is two (2). The distance between adjacent ones of the signal electrodes 3 in each block has a pitch $P_T$, which is, for example, 1.0 mm. The pitch $P_T$ is selected to be equal to or may be slightly larger than an average width or tube diameter of the gas discharge tubes. The distance $P_G$ between two adjacent ones of the signal electrodes of any two respective adjacent ones of the blocks (between the blocks 301 and 302, between 303 and 304, . . . , and between 307 and 308) is selected to be slightly larger than the pitch $P_T$, i.e. $P_G(>P_T)$. For example, for the tube widths having an error E, the distance $P_G$ is determined to have a fixed value within a range of from $P_T\times(1+2aE)$ to $P_T\times(1+3aE)$. For example, for the pitch $P_T$ and tube width being 1.0 mm, the error in tube width of the discharge tubes being 1%, and the number of the gas discharge tubes in one block being twelve (12) (i.e. a=4), the distance $P_G$ is a value within a range of from 1.09 mm to 1.12 mm. Each one block of discharge tubes (11R, 11G, . . . , 12B), . . . , or (17R, 17G, . . . , 18B) includes the number, a, of sets of gas discharge tubes, in which each one set includes three gas discharge tubes respectively emitting light of the R, G and B primary colors. In other words, each one block of discharge tubes is formed by 3×a gas discharge tubes, which are disposed in contact with each other on the signal electrodes 3 of the associated block.

With the above-described arrangement in which the plurality of signal electrodes 3 formed on the rear support 32 are divided into the blocks B1, B2, . . . , Ba, with the distance $P_G$ between two adjacent ones of the signal electrodes in any two respective adjacent ones of the blocks (between 301 and 302, between 303 and 304, . . . , between 307 and 308) determined to be larger than the distance $P_T$ between adjacent ones of the signal electrodes 3 in each block, the cumulative misregistrations between the signal electrodes 3 and the gas discharge tubes (11R, . . . , 12B) in a block can be absorbed by the distance $P_G$ between the signal electrode of that block and the adjacent signal electrode of the other block adjacent to that block (between the blocks 301 and 302, between 303 and 304, . . . , or between 307 and 308). In this way, irregular intervals Gb are disposed between the gas discharge tubes, between 12B and 13R, between 14B and 15R, . . . , and between 16B and 17R of the adjacent blocks. Accordingly, there is no undesirable magnitude of misregistrations between the signal electrodes 3 and the gas discharge tubes 11R, 11G, . . . , 18B in the display device 10.

For assembling the display device 10, the rear support 32, on which the signal electrodes 3 are formed, is prepared such that the distance (or pitch) between the adjacent signal electrodes 3 within a block differs from the distance (or pitch) between two adjacent ones of the signal electrodes at the respective adjacent ends of any two respective adjacent ones of the blocks, and then the blocks of gas discharge tubes are disposed on the rear support 32, in such a manner that the gas discharge tubes (11R, . . . , 12B), . . . , or (17R, . . . , 18B) of each block are disposed in contact with each other, being registered with respect to either one of the two signal electrodes at the opposite ends of that block. In this manner, the display device 10 can be manufactured with ease.

Figure 5A:
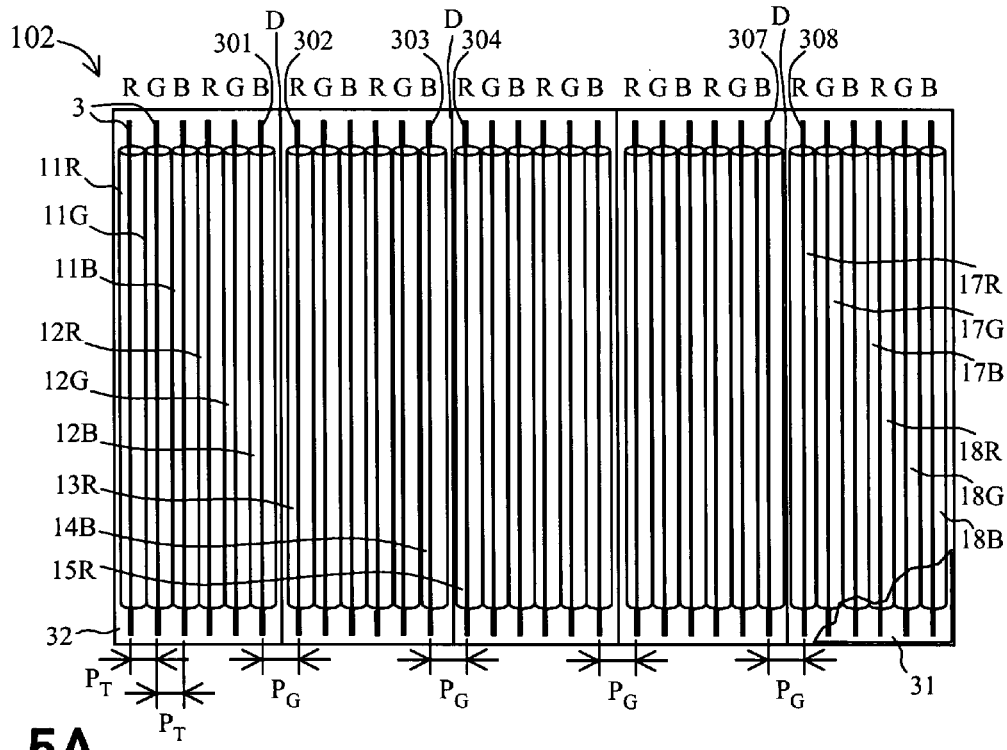
FIGS. 5A and 5B show an example of modification of the embodiment shown in FIGS. 4A and 4B, and are front and side views, respectively, of a display device in accordance with another embodiment of the invention, which includes the plurality of blocks of the gas discharge tubes disposed on a plurality of rear support substrates.
Figure 5B:
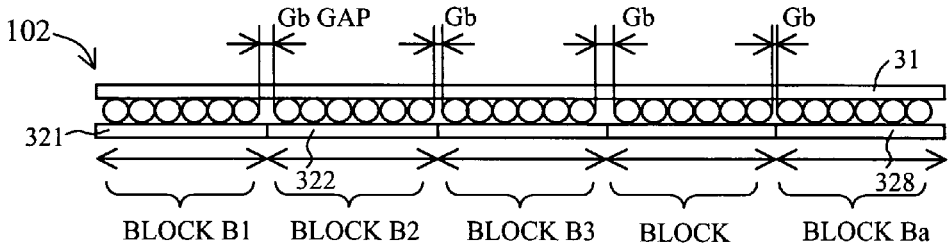

FIGS. 5A and 5B show an example of modification of the embodiment shown in FIGS. 4A and 4B, and are front and side views, respectively, of a display device 102 in accordance with another embodiment of the invention. The display device 102 includes the plurality of blocks B1, B2, . . . , Ba of the gas discharge tubes (11R, 11G, 1B, 12R, 12G, 12B), . . . , and (17R, 17G, 17B, 18R, 18G, 18B) disposed on a plurality of rear support substrates or base plates 321, 322, . . . , 328.

In FIGS. 5A and 5B, the rear support 32 is divided along dividing lines D between several pairs of adjacent signal electrodes of the respective adjacent blocks (between the blocks 301 and 302, between 303 and 304, . . . , and between 307 and 308), into the plurality of block substrates or base plates 321, 322, . . . , and 328. A plurality of signal electrodes 3 in the block B1, B2, or Ba are disposed on the corresponding rear support substrate 321, 322, . . . , or 328. The structure of the remainder of the display device 102 is similar to that of the display device 10 shown in FIGS. 4A and 4B. In other words, the rear support 32 of this embodiment is formed of a plurality of divided, separate rear supports 321, 322, . . . , and 328, and one block of 3×a signal electrodes 3 is formed on each of the plurality of separate, rear supports 321, 322, . . . , and 328.

Each block B1, B2, . . . , or Ba of the display device 102 is formed of a combination of the rear support substrate 321, 322, . . . , or 328 with an associated group of gas discharge tubes (11R, . . . , 12B), . . . , or (17R, . . . , 18B). The respective blocks B1, B2, . . . , and Ba have the same dimensions, shape and configuration.

Similarly to the above-described embodiment, the cumulative misregistrations between the signal electrodes 3 and the gas discharge tubes (11R, . . . , 12B), or (17R, . . . , 18B) in each block is absorbed by the distance $P_G$ between the signal electrode of that block and the adjacent electrode of the other block adjacent to that block (between the blocks 301 and 302, between 303 and 304, . . . , or between 307 and 308).

For assembling the display device 102, each group of the adjacent gas discharge tubes (11R, . . . , 12B), . . . , or (17R, . . . , 18B) are disposed in contact with each other and bonded together on the signal electrodes 3 of the corresponding block B1, B2, . . . , or Ba on the corresponding rear support substrate 321, 322, . . . , or 328, and then the plurality of blocks comprised of the respective support substrates 321, 322, . . . , and 328 of the substrate 32 with the disposed gas discharge tubes (11R, . . . , 12B), . . . , and (17R, . . . , 18B) are combined into the one display device 102. In this way, the display device 102 is manufactured easily.

Figure 6A:
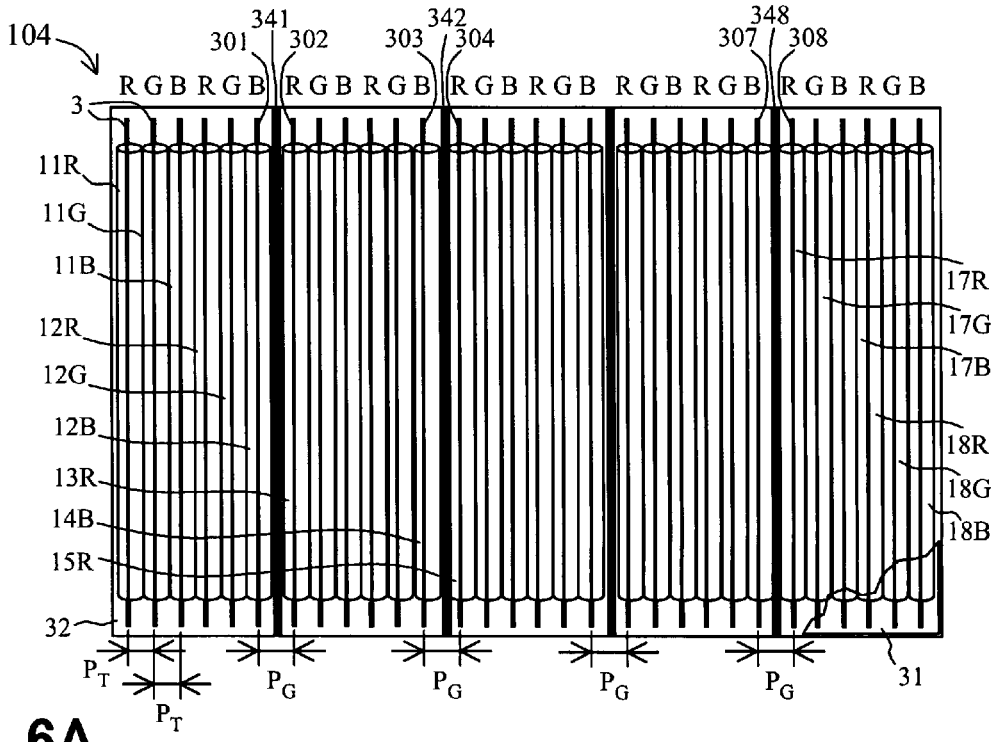
FIGS. 6A and 6B show a modification of the embodiment shown in FIGS. 4A and 4B, and are front and side views, respectively, of a display device in accordance with a further embodiment of the invention, which includes a plurality of blocks of gas discharge tubes.
Figure 6B:
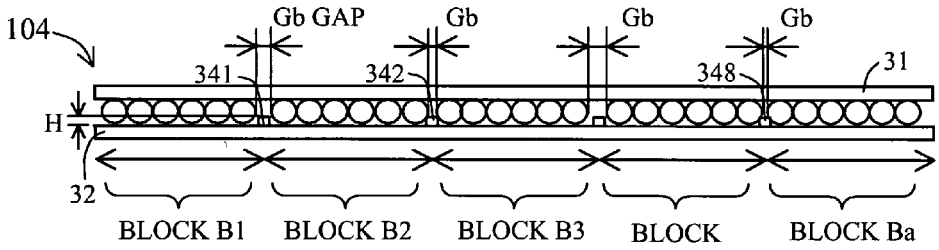

FIGS. 6A and 6B show a modification of the embodiment shown in FIGS. 4A and 4B, and are front and side views, respectively, of a display device 104 in accordance with a further embodiment of the invention. The display device 104 includes the plurality of blocks of gas discharge tubes (11R, 11G, 11B, 12R, 12G, 12B), and (17R, 17G, 17B, 18R, 18G, 18B).

In FIGS. 6A and 6B, ribs 341, 342, . . . , 348 are formed along the dividing lines extending through the midpoints between respective adjacent blocks, i.e. between several respective adjacent signal electrodes, (between the blocks 301 and 302, between 303 and 304, between 307 and 308) of the adjacent blocks B1, B2, . . . , Ba on the rear support 32. Each of the ribs 341, 342, 348 has a height H smaller than the radius or a half of the height of the gas discharge tube measured perpendicularly to the display screen. For example, for the tube diameter of 1.0 mm, the height H has a fixed value in the range of from 0.2 mm to 0.3 mm. The ribs 341, 342, . . . , 348 are black or dark in color, or at least their top surfaces are preferably black or dark in color. The structure of the remainder of the display device 104 is similar to that of the display device 10 shown in FIGS. 4A and 4B.

Similarly to the embodiments described above, the cumulative error in misregistrations between the plural electrodes 3 and the gas discharge tubes (11R, 12B), . . . , or (17R, . . . , 18B) in a block is absorbed by the distance $P_G$ between the signal electrode of that block and the adjacent signal electrode of the other block adjacent to that block.

For assembling the display device 104, each group of the adjacent gas discharge tubes (11R, . . . , 12B), or (17R, . . . , 18B) are disposed in contact with each other and bonded together on the respective ones of the signal electrodes 3 in the corresponding one of the blocks B1, B2, . . . , and Ba on the rear support 32, by using the opposite steps formed between the blocks B1, B2, Ba of signal electrodes 3 on the rear support 32 and the ribs 341, 342, . . . , 348. In this manner, the display device 104 can be manufactured easily.

The ribs 341, 342, . . . , 348 may be bonded onto the rear support 32 by means of an adhesive. Alternatively, the rear support 32 with the ribs 341, 342, . . . , 348 may be formed by masking rib portions of a surface of an unprocessed substrate and etching away the unmasked portions.

Figure 7A:
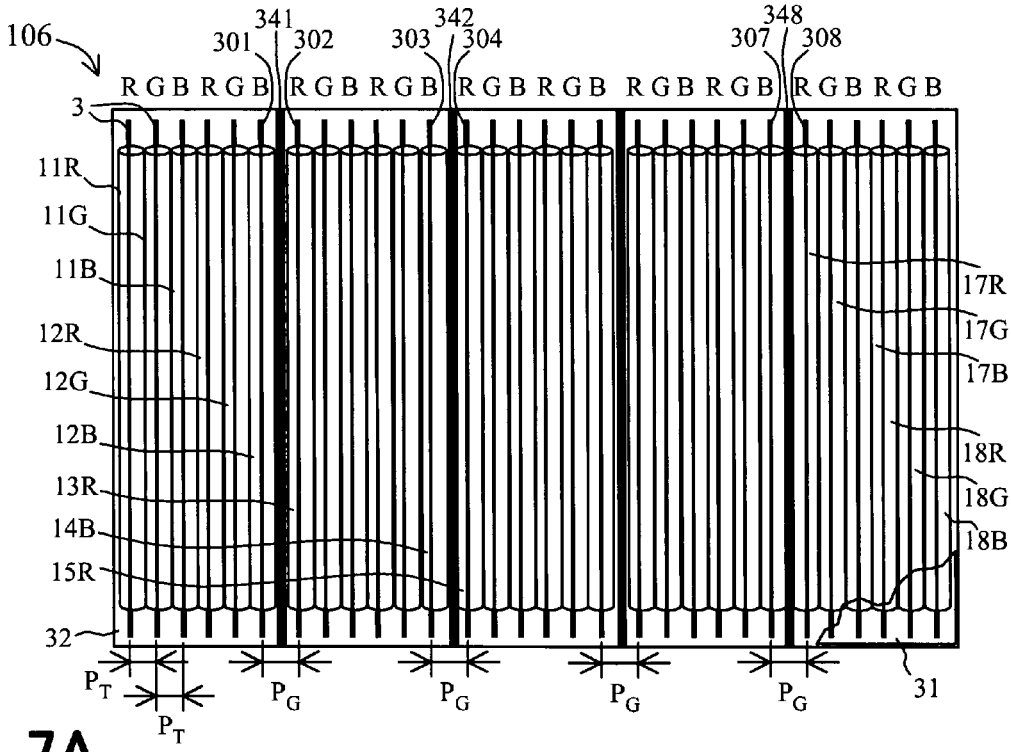
FIGS. 7A and 7B are front and side views of a display device in accordance with a still further embodiment of the invention, which includes a plurality of blocks of gas discharge tubes disposed on a plurality of rear support substrates.
Figure 7B:
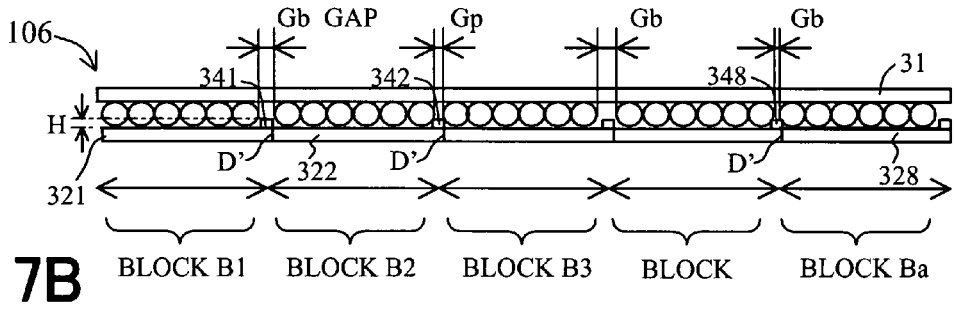

FIGS. 7A and 7B show a modification of the display device shown in FIGS. 6A and 6B, and are front and side views, respectively, of a display device 106 in accordance with a still further embodiment of the invention. The display device 106 includes the plurality of blocks B1, B2, . . . , Ba of the gas discharge tubes (11R, 11G, 11B, 12R, 12G, 12B), . . . , and (17R, 17G, 17B, 18R, 18G, 18B) disposed on a plurality of rear support substrates 321, 322, . . . , 328.

In FIGS. 7A and 7B, the rear support 32 is divided into the plurality of rear support substrates 321, 322, . . . , 328 along dividing lines D' extending along longitudinally extending side end surfaces of ribs 341, 342, . . . , 348, which ribs are located on the dividing lines between adjacent ones of the blocks B1, B2, . . . , Ba of the signal electrodes (between the blocks 301 and 302, between 303 and 304, . . . , between 307 and 308) on the rear support 32. Each of the blocks B1, B2, . . . , Ba of the plurality of signal electrodes 3 is disposed on the associated rear support substrate 321, 322, . . . , or 328. The structure of the remainder of the display device 106 is similar to that of the display device 104 shown in FIGS. 6A and 6B.

Each block B1, B2, . . . , or Ba of the display device 106 is formed by a combination of the rear support substrate 321, 322, . . . , or 328 with its corresponding group of gas discharge tubes (11R, . . . , 12B), . . . , (17R, 18B). The blocks B1, B2, . . . , and Ba have the same dimensions, shape and configuration.

Similarly to the embodiments described above, the cumulative misregistrations between the signal electrodes 3 and the gas discharge tubes (11R, . . . , 12B), or (17R, . . . , 18B) in each block can be absorbed by the distance $P_G$ between the signal electrode in that block and the adjacent signal electrode of the other block adjacent to that block (i.e. between the blocks 301 and 302, between 303 and 304, or between 307 and 308).

For assembling the display device 106, each group of adjacent gas discharge tubes (11R, . . . , 12B), or (17R, . . . , 18B) are disposed in contact with each other and bonded together on the signal electrodes 3 in the corresponding block B1, B2, . . . , or Ba on the corresponding rear support substrate 321, 322, . . . , or 328, by using the opposite steps formed between the blocks B1, B2, . . . , and Ba of signal electrodes 3 on the rear support substrates 321, 322, . . . , and 328 and the ribs 341, 342, . . . , 348. After that, the plurality of blocks comprised of the respective rear support substrates 321, 322, . . . , and 328 with the disposed gas discharge tubes (11R, . . . , 12B), and (17R, . . . , 18*b*) are combined together to form the one display device 106. In this manner, the display device 106 can be manufactured easily.

Figure 8A:
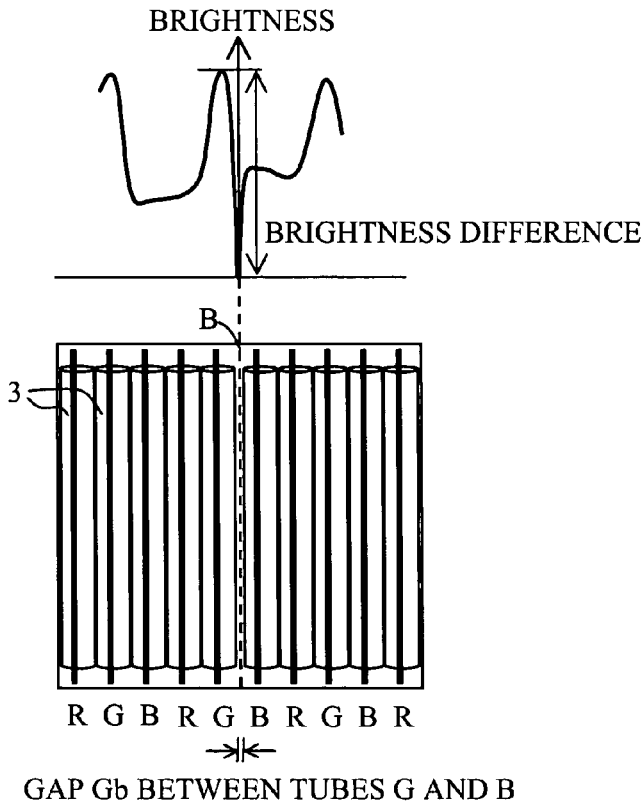
FIGS. 8A and 8B illustrate how the brightness changes in the vicinity of a block dividing line between the adjacent blocks, adjacent to which different color gas discharge tubes are disposed.
Figure 8B:
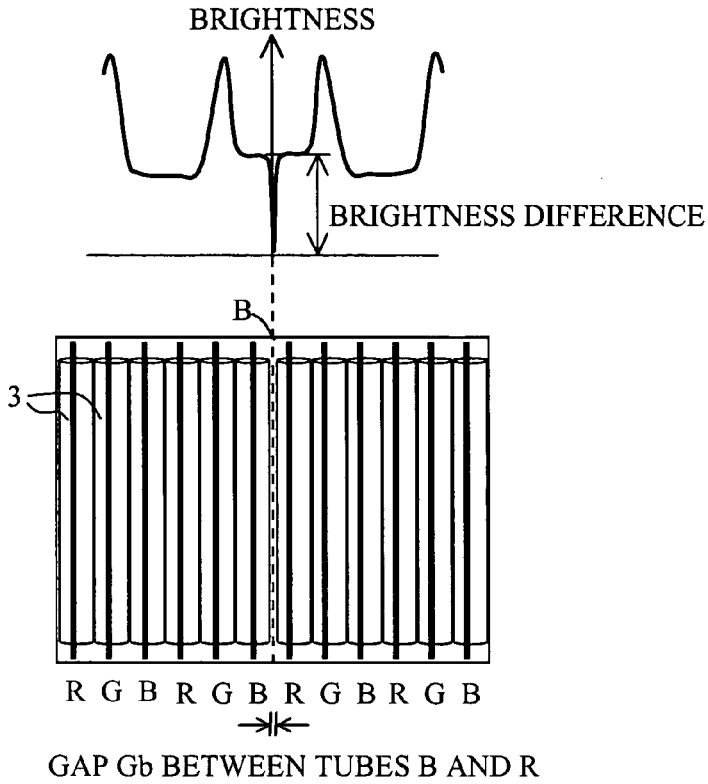

FIGS. 8A and 8B illustrate how the brightness changes in the vicinity of a block dividing line between the adjacent blocks, adjacent to which different color gas discharge tubes are disposed.

In FIG. 8A, a green-emitting (G) gas discharge tube with a relatively high brightness, and a blue-emitting (B) gas discharge tube with a relatively low brightness are disposed on respective opposite sides of a dividing line B, where there is a gap Gb between the gas discharge tubes. In this case, the brightness at the gap Gb is the lowest of the three, and hence the brightness change is large in the vicinity of the dividing line B, resulting in large difference in brightness. In this case, the presence of the dark gaps Gb in a picture on the display device 10 is noticeable.

In FIG. 8B, a blue-emitting (B) gas discharge tube with a relatively low brightness, and a red-emitting (R) gas discharge tube with a relatively low brightness are disposed on respective opposite sides of a dividing line B, where there is a gap Gb between the gas discharge tubes. In this case, the brightness change in the vicinity of the dividing line B is small, resulting in small brightness difference. Thus, the arrangement of R and B gas discharge tubes with the relatively low brightness on the respective opposite sides of the dividing line B as shown in FIG. 8B makes the dark gap Gb hardly noticed in a picture on the display device 10. Thus it is desirable to arrange the gas discharge tubes as shown in FIG. 8B. For this reason, the arrangement shown in FIG. 8B is employed in the above-described embodiments.

The above-described embodiments are only typical examples, and their combination, modifications and variations are apparent to those skilled in the art. It should be noted that those skilled in the art can make various modifications to the above-described embodiments without departing from the principle of the invention and the accompanying claims.

What is claimed is:

1. A display device, comprising:

a plurality of gas discharge tubes sandwiched between a front support member and a rear support member, the plurality of gas discharge tubes comprising triads of three color light-emitting gas discharge tubes;

a plurality of display electrodes formed on a surface of the front support member facing the gas discharge tubes to extend across the axial direction of the gas discharge tubes; and a plurality of signal electrodes formed on a surface of the rear support member facing the gas discharge tubes to extend along the longitudinal direction of said gas discharge tubes, the plurality of signal electrodes being divided into a number of groups, each group including an integer multiple of the three signal electrodes, wherein the signal electrodes in each group are spaced from one another by a first distance substantially equal to a width of each gas discharge tube, the gas discharge tubes corresponding to the signal electrodes in each group being substantially in contact with each other, the rear support member comprises a number of separated support sections, the number of separated support sections being equal to the number of the groups, each of the support sections has a number of the signal electrodes in each group formed thereon that is equal to a number of the gas discharge tubes corresponding to each group, and an irregular gap is provided between the gas discharge tube at an end of each group and the gas discharge tube at an adjacent end of an adjacent one of the groups.

2. The display device according to claim 1, wherein a rib extending along the longitudinal direction of the gas discharge tube is formed on only one side edge of a corresponding one of the support sections.

3. The display device according to claim 1, wherein each triad comprises red (R), green (G), and blue (B) light-emitting gas discharge tubes, and the gap between the adjacent groups is provided between the R and B light-emitting gas discharge tubes.

4. A display device, comprising:

a plurality of groups of gas discharge tubes disposed in parallel between a front support member and a rear support member, each group comprising an integer multiple of the gas discharge tubes;

the front support member having a first plurality of electrodes extending substantially in parallel disposed on a surface of the front support plate facing the gas discharge tubes; and the rear support member having a second plurality of electrodes extending substantially in parallel are disposed on a surface of the rear support plate facing the gas discharge tubes, the plurality of groups of gas discharge tubes being disposed respectively in association with the second plurality of electrodes;

the gas discharge tubes being disposed in such a manner that the adjacent gas discharge tubes in each group are substantially in contact with each other, and that the gas discharge tube at an end of each group of the gas discharge tubes and the gas discharge tube at an adjacent end of an adjacent one of the groups are spaced apart from each other with irregular gaps.

5. A method of manufacturing a display device comprising a front support sheet, a rear support sheet, and a plurality of gas discharge tubes sandwiched between the front support sheet and the rear support sheet thereof, comprising:

forming a plurality of display electrodes extending across the axial direction of the discharge tubes, on a surface of the front support sheet facing the gas discharge tubes;

forming a plurality of signal electrodes extending along the longitudinal direction of the gas discharge tubes on a surface of the rear support sheet facing the gas discharge tubes, the signal electrodes being divided into a plurality of groups, each group including a number of signal electrodes, the signal electrodes in each group being substantially spaced from each other by a first distance substantially equal to a width of each gas discharge tube, and the distance between the signal electrode at an end of each group of the signal electrodes and the signal electrode at the adjacent end of the adjacent group being substantially spaced by a second distance from each other, the second distance being larger than the first distance; and registering the gas discharge tubes in each group with respect to one of the signal electrodes of that group that is located at either one of the opposite ends of that group, the gas discharge tubes in that group being substantially in contact with each other, the gas discharge tube at an end of each group and the gas discharge tube at an adjacent end of an adjacent one of the groups being spaced apart from each other with an irregular gap.

6. A display device comprising:

a plurality of gas discharge tubes, the plurality of gas discharge tubes comprising red (R), green (G) and blue (B) light-emitting gas discharge tubes arranged in order;

a front support member having a plurality of display electrodes formed thereon to extend across the plurality of gas discharge tubes; and a rear support member comprising a plurality of support sections, each support section having a plurality of signal electrodes formed thereon to extend along the longitudinal direction of the gas discharge tubes;

the plurality of gas discharge tubes being divided into groups of integer multiples of the three gas discharge tubes, the adjacent gas discharge tubes in each group being substantially in contact with each other on the corresponding support section, the two adjacent gas discharge tubes of the respective adjacent groups being spaced apart from each other with an irregular gap.

7. The display device according to claim 6, wherein each group includes three multiplied by an integer of the gas discharge tubes, where the integer is between one and four.

8. The display device according to claim 6, wherein the two adjacent gas discharge tubes between the adjacent groups are R and B light-emitting gas discharge tubes.

9. The display device according to claim 6, wherein the rear support member is separated into support sections having the respective signal electrodes formed thereon, a number of the signal electrodes for each section corresponding to a number of the gas discharge tubes of a corresponding group.

10. A display device, comprising:

a plurality of gas discharge tubes arranged in order;

a single front support member having a plurality of display electrodes formed thereon to extend across the plurality of gas discharge tubes; and a plurality of rear support sheets, each sheet having a plurality of signal electrodes formed thereon to extend along the longitudinal direction of the gas discharge tubes, the plurality of gas discharge tubes being divided into groups of a given number of gas discharge tubes, the adjacent gas discharge tubes in each group being substantially in contact with each other on the corresponding rear support sheet, the two adjacent gas discharge tubes of the respective adjacent groups being spaced apart from each other by an irregular gap such that a gap between the two adjacent gas discharge tubes of the respective adjacent groups substantially absorbs a possible cumulative error in misregistrations between the gas discharge tubes in the corresponding group and the respective signal electrodes corresponding to the same corresponding group.

* * * * *

UNITED STATES PATENT AND TRADEMARK OFFICE

CERTIFICATE OF CORRECTION

PATENT NO. : 7,816,850 B2
APPLICATION NO. : 11/898913
DATED : October 19, 2010
INVENTOR(S) : Manabu Ishimoto et al.

It is certified that error appears in the above-identified patent and that said Letters Patent is hereby corrected as shown below:

Title Page, Column 1, under
"(65) Prior Publication Data

US 2008/0007176 A1 Jan. 10, 2008" insert
--Related U.S. Application Data

(63) Continuation of application No. PCT/JP2005/004745 filed on March 17, 2005.--.

Signed and Sealed this
Eighteenth Day of January, 2011

David J. Kappos

David J. Kappos
*Director of the United States Patent and Trademark Office*